United States Patent [19]

Fernandes

[11] 4,144,602

[45] Mar. 20, 1979

[54] FLAT CONTOUR SHEET

[76] Inventor: Marilyn M. Fernandes, 2952 Sierra Rd., San Jose, Calif. 95132

[21] Appl. No.: 861,963

[22] Filed: Dec. 19, 1977

[51] Int. Cl.[2] ..... A47C 9/00

[52] U.S. Cl. ..... 5/334 C; 5/335

[58] Field of Search ..... 5/334 R, 334 C, 335

[56] References Cited

U.S. PATENT DOCUMENTS

| | | | |
|---|---|---|---|
| 2,972,756 | 2/1961 | Monier et al. | 5/334 C |
| 3,083,379 | 4/1963 | Mariusky | 5/334 C |
| 3,243,827 | 4/1966 | Kintner | 5/334 C |

*Primary Examiner*—Casmir A. Nunberg
*Attorney, Agent, or Firm*—John J. Leavitt

[57] ABSTRACT

Presented is a generally flat contour sheet formed so as to fit snugly about and conform to the configuration of a mattress when applied thereto.

4 Claims, 5 Drawing Figures

FIG. 1.
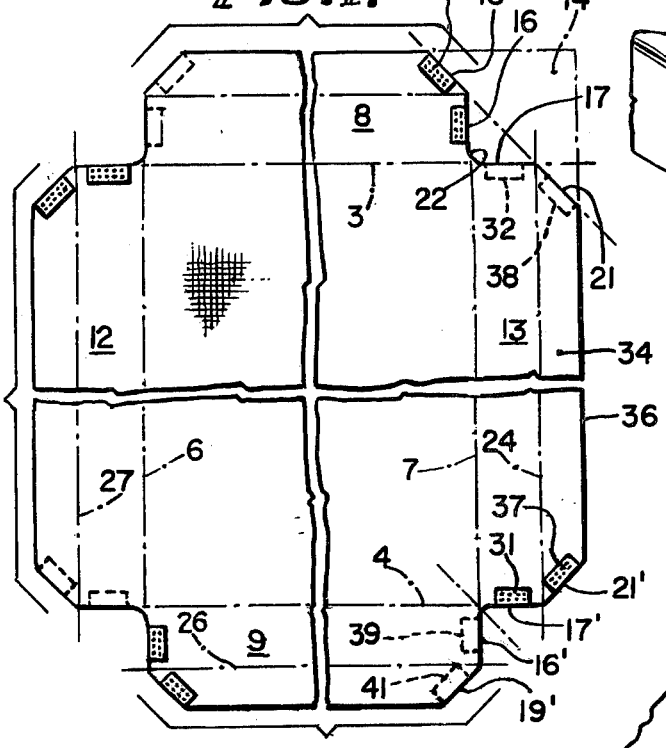
FIG. 4.
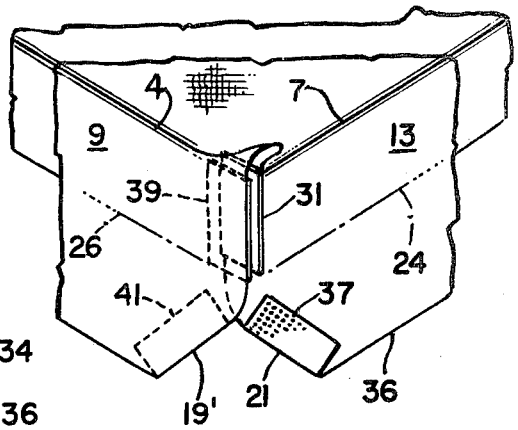
FIG. 2.
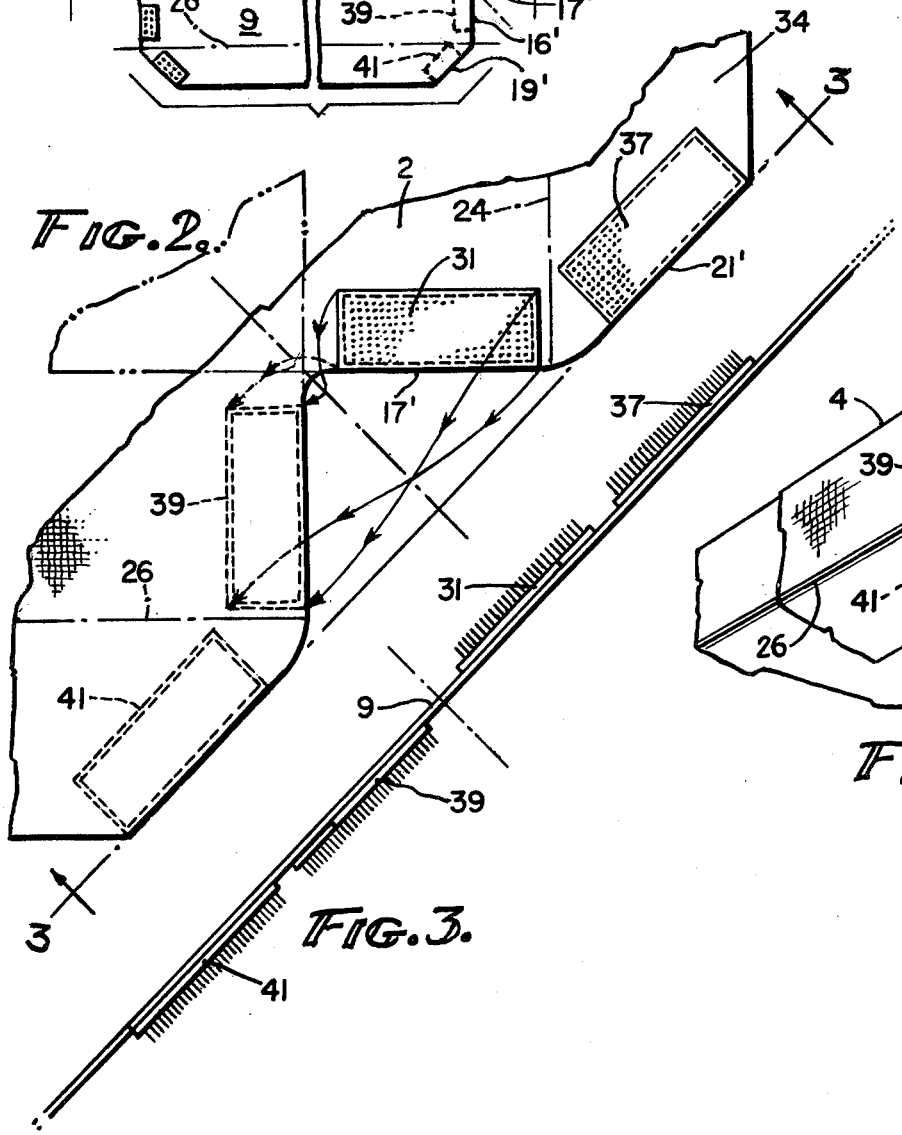
FIG. 3.
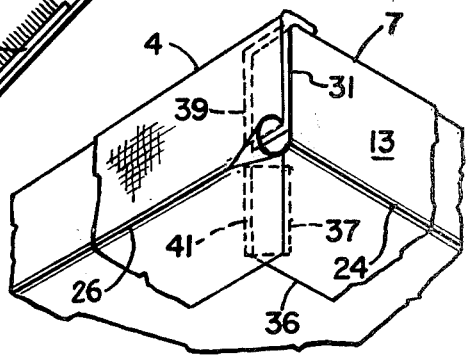
FIG. 5.

FLAT CONTOUR SHEET

BACKGROUND OF THE INVENTION

1. Field of the Invention

This invention relates to mattress covers, and particularly to contour type sheets adapted to be applied over a mattress.

2. Description of the Prior Art

It is believed that the prior art relating to this invention is found in Class 5, sub-class 334 C. A search of that class and sub-class has revealed U.S. Pat. No. 2,462,156 which teaches the concept of a bed sheet in which a cut-out portion is provided adjacent each end so that to provide a flap useful in forming the sheet to the contour of the mattress over which it is spread. Fastening means of various types may be attached to the marginal edges of the recess and flap to fasten the flap to the sheet after it is formed over the corner of a mattress.

U.S. Pat. No. 2,931,055 teaches the formation of sockets in the marginal portions of the sheet to permit tucking and attaching a folded corner of the sheet so as to retain it in a contoured condition.

U.S. Pat. No. 2,972,756 teaches a construction in which buttonholes are placed adjacent the marginal corners of a sheet. The sheet is then folded in such a way that the buttonholes are brought into alignment so that a double-headed button may be inserted through the aligned holes.

U.S. Pat. No. 3,083,379 teaches a structure in which the corners of the sheet are cut away to facilitate conforming the corner portion of the sheet to the underlying mattress. In one embodiment taught by this patent snap fasteners are used to hold the marginal portion of the sheet in contoured position. In another embodiment, the patent teaches the use of an enlarged buttonhole and a specifically shaped button or locking member to accomplish the same purpose. A third embodiment taught by the patent includes the use of slits engaged by flaps to retain marginal portions in contoured position.

U.S. Pat. No. 3,243,827 appears to be the most pertinent patent in that it teaches the formation of a recess in the corner of the sheet to facilitate conformation of the sheet to the shape of the mattress. One of the important distinctions of the present invention as compared to the structure taught in U.S. Pat. No. 3,243,827 is that in the present invention no part of the marginal edge portions that fit around the mattress extend beyond the limits of the panel before the sheet is formed, thus eliminating waste of sheet material when the sheet is formed as in the configuration taught by U.S. Pat. No. 3,243,827.

SUMMARY OF THE INVENTION

In terms of broad inclusion, the flat contour sheet of the invention comprises initially a generally rectangular flat piece of woven material each corner of which has been lopped off at a 45° angle with the resultant 45° edge being formed with an additional recess having the general configuration of an isosceles triangle with the base of the triangle being in planar alignment with the 45° edge of the sheet. This results in the sheet being formed with laterally extending marginal edges at each side and at each end, with the apex of the triangular recess being associated with the fold line that is formed when the sheet is draped over a mattress and the marginal edge and side portions tucked thereunder. Means are provided on the end edges of the marginal side and end edge portions for engaging the associated end edges so as to retain the sheet in contoured condition about the mattress.

BRIEF DESCRIPTION OF THE DRAWING

FIG. 1 is a plan view of the flat contour sheet of the invention, portions being broken away to reduce its size.

FIG. 2 is a fragmentary plan view of one corner of the flat contour sheet, with the associated corner of a mattress illustrated in broken lines. This view is shown in enlarged size, and the arrowed lines in the view indicate the ultimate association of the fastening means for retaining the flat contour sheet conformed about the marginal edge of an underlying mattress.

FIG. 3 is a fragmentary edge view taken in the plane indicated by the line 3—3 in FIG. 2.

FIG. 4 is a fragmentary perspective view illustrating one corner of the flat contour sheet partially draped about a corner of an associated mattress.

FIG. 5 is a fragmentary perspective view similar to FIG. 4, but showing one corner of the flat contour sheet fully enveloped about a corner of the underlying mattress and viewed from the underside thereof.

DESCRIPTION OF THE PREFERRED EMBODIMENT

In terms of greater detail, the flat contour sheet of the invention comprises a generally flat quadrilateral panel of fabric, preferably woven, having a main or central area designated generally by the numeral 2 and defined at opposite ends by the broken lines 3 and 4 which may be taken to be fold lines. On the lateral sides, the main area is defined by broken lines 6 and 7, and this main area defined by the broken lines 3, 4, 6 and 7 corresponds in general to the length and width dimension of a conventional mattress, whatever that size may be.

As illustrated in FIG. 1, the flat contour sheet is formed at each end to provide marginal end portions 8 and 9 integral with and forming an extension of the main area 2 of the sheet in the direction of its length, and provided also with marginal side portions 12 and 13 which also form an integral part of the sheet and constitute lateral extensions of the main area of the sheet in the direction of its width.

As illustrated in FIG. 1, the flat contour sheet of the invention is formed from a generally rectangular panel the corners of which have been lopped off as indicated in the upper right hand corner of FIG. 1. As there shown in broken lines, a generally quadrilateral portion 14 is cut away at each corner so as to leave the end and side portions extending from the main area of the sheet, the end edge of the edge portion being designated by the numeral 16 and the end edge of the side portion being designated by the numeral 17. Additionally, from each outside corner of each end and side edge portion there is lopped off a triangular portion 18 as viewed in FIG. 1 in broken lines to thus leave an angular edge portion 19 that lies in general alignment with a similar edge 21 similarly formed on the side edge portion 13. As seen in FIG. 1, the edges 19 and 21 appear on adjacent end and side portions, respectively, and are in alignment one with the other and lie at about a 45° angle with respect to the corner of the sheet.

Removal of the quadrilateral portion 14 to leave the edges 16 and 17 in the end and side edge portions creates a gore 22 where the edges 16 and 17 intercept one another, and this gore in general is positioned on the panel at a point coincident with the corner of the underlying mattress. In the illustration of FIG. 1, in the interest of clarity in the drawing, the gore 22 is shown spaced somewhat from the broken lines 3, 4, 6 and 7 defining the width and length dimensions of the underlying mattress. In actuality, the gore and corner of the mattress are preferably coincident one with the other.

Again referring to FIG. 1, it will be noted that lines 23, 24, 26, and 27 have been illustrated in the end and side edge portions 8, 13, 9 and 12, respectively. These lines are akin to fold lines and are illustrated in the drawing for purposes of illustration only, and of course do not appear in the finished product. They are included herein to illustrate that the portion of each of the end and side edge portions that lies between the broken lines defining the main area and the fold line being discussed, is equivalent to the thickness dimension of the mattress for which the sheet is designed, while the portion of the end and side edge portions extending beyond the fold line under discussion constitutes that portion of the side and edge portions that is tucked under the edge portion of the mattress. It is important to understand the distinction between that portion of each of the end and side portions that corresponds to the thickness of the mattress and that portion that is tucked under the mattress for reasons which will hereinafter be explained.

To effectively secure the end and side edge portions of the sheet conformed about the edge portions of an underlying mattress, fastening means are mounted on each of the end and side edge portions so that when the end and side edge portions are properly contoured about the corresponding edges of the mattress, the fastening means associated with the opposite ends of each end edge portion come into engaging relationship with the corresponding fastening means mounted adjacent the associated end edges of the side edge portions. Thus, referring to FIG. 1, with respect to the lower right hand corner of the figure, which corresponds to FIG. 2 in enlarged form, it will be seen that the side edge portion 13 is provided with a short strip 31 of tape having hooks or barbs projecting therefrom and sold under the tradename "Velcro." The tape is fastened to the surface of the side edge portion adjacent the end edge 17' thereof. At the opposite end of the side edge portion 13, adjacent the edge 17 thereof, there is a complimentary strip 32 of felted material permanently secured to the opposite side of the sheet material from the side on which the "Velcro" tape 31 is secured.

Again referring to the lower right hand corner of FIG. 1, and the corresponding illustration in enlarged form in FIG. 2, it will be seen that the lateral portion 34 of the side edge portion 13 that lies bounded between the fold line 24 and the extreme right hand edge 36 of the side edge portion 13 is provided with an angular edge 21' that lies at an angle of 45° to the associated edge 17', this edge 21' being complimentary on the right side edge portion 13 with the edge 21. Positioned adjacent to the edge 21' is a short strip of "Velcro" tape 37, anchored to the facing surface of the sheet as illustrated, and comprising a multiplicity of tiny hooks or barbs adapted to engage a complimentary felted strip when brought into engagement therewith. Thus, the opposite end of the side edge portion 13 adjacent to edge 21 is provided with such complimentary strip 38 of felted material, the strip 38 being permanently secured to the opposite side of the sheet material from the side on which the strip 37 of barbed "Velcro" tape is attached. It will thus be seen that the right side edge portion 13 of the sheet is provided at one end with barbed "Velcro" tape portions 31 and 37 securely fastened to one surface of the sheet, while at the opposite end of this side edge portion, the complimentary felted strips 32 and 38 are permanently secured to the opposite side of the sheet material.

In like manner, each of the end edge portions 8 and 9 and the side edge portion 12 are provided with two strips of barbed "Velcro" tape material at one end of each portion and a complimentary felt strip at the opposite end of that portion but on the opposite side thereof. Thus, referring again to the lower right hand corner of FIG. 1, and the illustration of that corner in enlarged form in FIG. 2, the end edge portion 9 is provided adjacent the edge 16' with a "Velcro" felted pad 41. As seen in FIG. 2, the felted pads 39 and 41 are positioned on the opposite side of the sheet from the side on which the corresponding barbed pads 31 and 37 are secured. This same relationship obtains at each of the corners of the sheet so that when one of the side edge portions of the sheet, say the side edge portion 13, is folded downwardly along the fold line 7, the thickness or height of the mattress is encompassed by that portion of the side edge portion lying between the fold lines 7 and 24, while the end edge portion 9, when folded downwardly around the mattress in similar fashion, causes the felted pad 39 to be placed in a position to be engaged by the hook members of the pad 31 on the adjacent side edge portion of the sheet. Thus, the side and end edge panels that correspond to the height or thickness of the mattress are held in to conform to the box-like configuration of the mattress. Thereafter, the extreme end edge portions of each of the side and end edge portions are tucked under the mattress and because of the configuration and placement of the pads 37 and 41 in the lower right hand corner of the sheet, for instance, the felt pad 41 is placed in a position to be engaged by the hook members in the "Velcro" strip 37. This construction and interrelationship is illustrated clearly in FIGS. 4 and 5.

In viewing the drawings, it should be understood that at the gore 22 when the end and side edge portions are folded down around the mattress, there will be an accommodation of the sheet to the shape of the mattress due to the flexibility of the sheet. This accommodation and the adjustment of the side and end edge portions to interlock the barbed strips 31 and 37 with the felted pads 39 and 41, respectively, is difficult to illustrate in a line drawing. It should be understood, however, that when the sheet is draped over the mattress, the end edge portions drape downwardly over the end edges of the mattress and the side edge portions drape downwardly over the side edges of the mattress. In this position of the end and side edge portions, the sheet is pulled taut to the corners and the interengageable barbed and felted pads are engaged so as to retain the sheet in a box-like configuration tightly conforming to the corner configuration of the underlying and enclosed mattress. The remaining portion of each of the side and end edge portions that dangles below the mattress is then tucked under the mattress and such placement of the end and side edge portions of the sheet under the mattress automatically positions the interengaging pads 37 and 41, for instance, and in like manner, interengages the corresponding elements at the other corners of the sheet, thus securing the outboard portion of each end and side edge portion under the mattress.

Having thus described the invention, what is claimed to be novel and desired to be protected by Letters Patent of the United States is as follows: I claim:

1. A sheet for use with a mattress having a generally flat area on which a person may repose, said mattress having edge portions of appreciable thickness, said sheet comprising:

(a) a generally flat quadrilateral panel of fabric having a main area dimensioned to correspond to the flat area of the mattress and having marginal edge portions integral with and extending from said main area and defined by end and side edges, each said marginal edge portion having a length measured between said end edges no longer than the corresponding dimension of the associated edge portion of the mattress and having a width measured between the roots of said end edges and said side edge greater than the appreciable thickness of the associated edge portion of the mattress;

(b) diagonal edges formed at opposite ends of each marginal edge portion of said panel, the diagonal edges of adjacent marginal edge portions at each corner being substantially in alignment whereby no part of said marginal edge portion projects beyond said end and side edges; and (c) means on said panel associated with said end and diagonal edges on each marginal edge portion for detachably securing together the associated end and diagonal edges of adjacent marginal edge portions when said marginal edge portions are tucked under the mattress to thereby form a contoured corner on said sheet.

2. The combination according to claim 1, in which said diagonal edges formed at opposite ends of the marginal edge portions are formed at 45° to the end and side edges thereof.

3. The combination according to claim 1, in which said marginal edge portions are defined by generally right angle notches at each corner of the sheet, each notch defined by the end edges of adjacent marginal edge portions of the panel.

4. The combination according to claim 1, in which said means for securing associated end and diagonal edges of adjacent marginal edge portions comprise felt-like pads and hook pads secured to selected end and diagonal edges of adjacent marginal edge portions whereby when said marginal edge portions are tucked under said mattress said end and diagonal edges overlap and said felt-like pads are releasably engaged by said hook pads to retain the sheet in contoured form about the edge portions of the mattress.

* * * * *